United States Patent [19]

Wlezien

[11] Patent Number: 4,861,296

[45] Date of Patent: Aug. 29, 1989

[54] MARINE PROPULSION DEVICE EXHAUST SYSTEM

[75] Inventor: Richard A. Wlezien, Antioch, Ill.

[73] Assignee: Outboard Marine Corporation, Waukegan, Ill.

[21] Appl. No.: 137,509

[22] Filed: Dec. 23, 1987

[51] Int. Cl.[4] ..... F01H 3/02

[52] U.S. Cl. ..... 440/89; 440/88

[58] Field of Search ..... 440/88, 89; 137/216; 55/DIG. 30; 60/310, 311

[56] References Cited

U.S. PATENT DOCUMENTS

| | | | |
|---|---|---|---|
| 1,816,371 | 7/1931 | Hefti | 440/89 |
| 3,183,880 | 5/1965 | Shimanckas | 440/52 |
| 3,310,022 | 3/1967 | Kollman | 440/75 |
| 3,750,614 | 8/1973 | Giacosa | 440/89 |
| 3,759,041 | 9/1973 | North | 60/310 |
| 4,019,456 | 4/1977 | Harbers | 440/89 |
| 4,354,849 | 10/1982 | Sanni | 440/89 |
| 4,504,238 | 3/1985 | Neisen | 440/89 |
| 4,687,450 | 8/1987 | Bland | 440/89 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

Disclosed herein is a marine propulsion device comprising a stern drive unit including a gimbal housing adapted to be fixed to a boat transom, a gimbal ring connected to the gimbal housing for pivotal movement relative to the gimbal housing about a generally vertical axis, a propulsion unit connected to the gimbal ring for pivotal movement relative to the gimbal ring about a generally horizontal axis, an exhaust gas passage in the propulsion unit and including an outlet normally located under water and an inlet normally located above the water, a flexible exhaust gas bellows having a rearward end connected to the inlet of the exhaust gas passage in the propulsion unit and having a forward end, and an exhaust gas and coolant discharge conduit extending through the gimbal housing and comprising a forwardly located inlet passage adapted to receive combined exhaust gas and coolant discharge from an engine and including a rearwardly located lower transverse wall, an exhaust gas discharge passage located rearwardly of and communicating with the inlet passage at least in part above the transverse wall, the exhaust gas discharge passage having a rearward end connected to the forward end of the bellows, and a coolant discharge passage communicating with the inlet passage in forwardly adjacent relation to the transverse wall.

12 Claims, 2 Drawing Sheets

MARINE PROPULSION DEVICE EXHAUST SYSTEM

BACKGROUND OF THE INVENTION

The invention relates to exhaust systems for marine propulsion devices and, more particularly, to means in such exhaust systems for relieving exhaust gas backpressure.

In prior marine propulsion devices, it is common to discharge exhaust gases and coolant water underwater in order to reduce noise. This frequently results in undesirable backpressure on the engine, because the exhaust gases and coolant water must follow a relatively long path before being discharged.

Attention is directed to the following U.S. patents:

Hefti, 1,816,371, issued: July, 1931;
Kollman, 3,310,022, issued: March 1967;
Giacosa, 3,750,614, issued: Aug. 7, 1973;
North, et al., 3,759,041, issued: Sept. 18, 1973;
Harbert, 4,019,456, issued: Apr. 26, 1977;
Sanmi, et al., 4,354,849, issued: Oct. 19, 1982;
Neisen, 4,504,238, issued: March 1985;
Bland, 4,687,450, issued: Aug. 18, 1987.

Attention is also directed to the following British Patents:

Great Britian: 710,083
Great Britian: 1,410,489.

SUMMARY OF THE INVENTION

The invention provides a marine propulsion device comprising a stern drive unit including a member adapted to be fixed to a boat transom, or fixed to an engine assembly having a portion passing thru a transom, a propulsion unit connected to the member for pivotal steering movement relative to the member and for vertical tilting movement relative to the member, an exhaust gas passage in the propulsion unit and including an outlet normally located under water and an inlet normally located above the water, a flexible exhaust gas bellows having a rearward end connected to the inlet of the exhaust gas passage in the propulsion unit and having a forward end, and an exhaust gas and coolant discharge conduit extending through the member and comprising a forwardly located inlet passage adapted to receive combined exhaust gas and coolant discharge from an engine and including a rearwardly located lower transverse wall, which inlet passage is undivided forwardly of the transverse wall, an exhaust gas discharge passage located rearwardly of and communicating with the inlet passage above the transverse wall, which exhaust gas discharge passage has a rearward end connected to the forward end of the bellows, and a coolant discharge passage communicating with the inlet passage in forwardly adjacent relation to the transverse wall.

The invention also provides a marine propulsion device comprising a stern drive unit including a gimbal housing adapted to be fixed to a boat transom, a gimbal ring connected to the gimbal housing for pivotal movement relative to the gimbal housing about a generally vertical axis, a propulsion unit connected to the gimbal ring for pivotal movement relative to the gimbal ring about a generally horizontal axis and including a propeller, an exhaust gas passage in the propulsion unit and including an outlet normally located under water and an inlet normally located above the water, a flexible exhaust gas bellows having a rearward end connected to the inlet of the exhaust gas passage in the propulsion unit and having a forward end, and an exhaust gas and coolant discharge conduit extending through the gimbal housing and comprising a forwardly located inlet passage adapted to receive combined exhaust gas and coolant discharge from an engine, which inlet passage includes an outlet end, a bottom wall, a side wall, and, at the outlet end, a lower transverse half wall, a rearwardly located exhaust gas discharge passage including an outlet portion connected to the forward end of the bellows, and an intermediate portion having an upper part with a forward end communicating with the inlet passage and with a rearward end communicating with the outlet portion of the exhaust gas discharge passage, which intermediate portion also has a lower part having a forward end communicating through the transverse half wall with the inlet passage, and a rearward end communicating with the outlet portion of the exhaust gas discharge passage, and a coolant discharge passage communicating with the inlet passage through the bottom wall and adjacent the side wall and the transverse half wall.

The invention also provides a housing adapted to be mounted on a boat transom, which housing includes an exhaust gas and coolant discharge conduit extending through the housing and comprising a forwardly located inlet passage adapted to receive combined exhaust gas and coolant discharge from an engine and including a rearwardly located lower transverse wall and being undivided forwardly of the transverse wall, an exhaust gas discharge passage located rearwardly of and communicating with the inlet passage above the tranverse wall, which exhaust gas discharge passage has a rearward outlet end, and a coolant discharge passage communicating with the inlet passage in forwardly adjacent relation to the transverse wall.

The invention also provides a housing adapted to be mounted on a boat transom, which housing includes an exhaust gas and coolant discharge conduit extending through the housing and comprising a forwardly located inlet passage adapted to receive combined exhaust gas and coolant discharge from an engine, which inlet passage includes an outlet end, a bottom wall, a side wall, and, at the outlet end, a lower transverse half wall, a rearwardly located exhaust gas discharge passage including an outlet portion, and an intermediate portion having an upper part with a forward end communicating with the inlet passage and a rearward end communicating with the outlet portion of the exhaust gas discharge passage, which intermediate portion also has a lower part having a forward end communicating through the transverse half wall the inlet passage and a rearward end communicating with the outlet portion of the exhaust gas discharge passage, and a coolant discharge passage communicating with the inlet passage through the bottom wall and adjacent the side wall and the transverse half wall.

The invention also provides a housing adapted to be mounted on a boat transom, which housing includes an exhaust gas and coolant discharge conduit extending through the housing and comprising a forwardly located inlet passage adapted to receive combined exhaust gas and coolant discharge from an engine, which inlet passage includes an inlet end and an outlet end, and is of generally constant generally rectangular configuration between the inlet end and the outlet end, and including a bottom wall, a side wall, and, at the outlet end, a lower transverse half wall, a rearwardly located exhaust gas discharge passage including an outlet portion of generally constant circular cross section, and an intermediate portion having an upper part with a forward end communicating directly with the inlet passage and with a rearward end communicating with the outlet portion of the exhaust gas discharge passage, which upper part tapers inwardly and rearwardly from the inlet passage to the outlet portion, which intermediate portion also has a lower part having a forward end communicating through the transverse half wall with the inlet passage and a rearward end communicating with the outlet portion of the exhaust gas discharge passage, and a coolant discharge passage communicating with the inlet passage through the bottom wall and adjacent the side wall and the transverse half wall.

Other features and advantages of the invention will become apparent to those skilled in the art upon review of the following detailed description, claims and drawings

Figure 1:
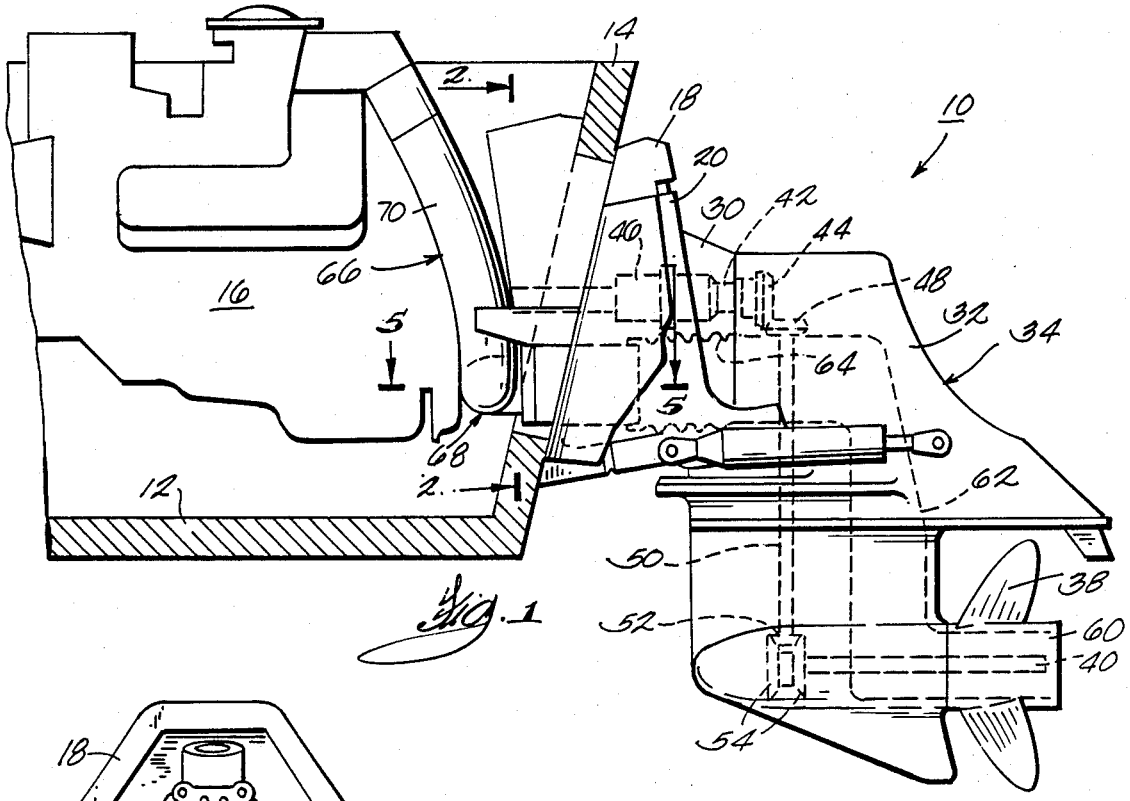
FIG. 1 is a side elevational view, partially cut away, of a marine propulsion device embodying the invention.
Figure 2:
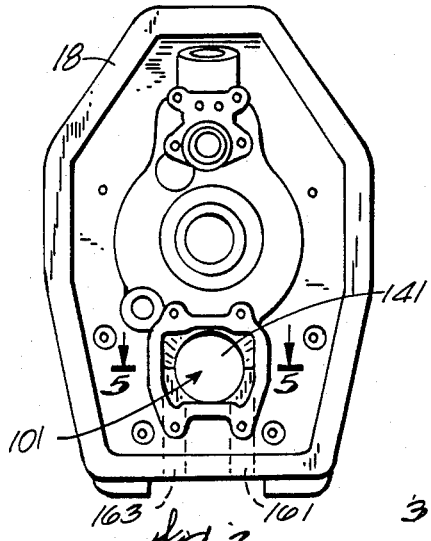
FIG. 2 is an end elevational view of the front end of the gimbal housing, which view is taken generally along line 2—2 of FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type.

As best shown in FIG. 1, the marine propulsion device 10 comprises an engine 16 securely mounted on the boat frame by suitable means such as rubber mounts (not shown). The marine propulsion device 10 also includes a stern drive comprising a member adapted to be fixed to the transom, assembly having a portion or fixed to an engine passing thru a transom, such as shown, for instance, in the U.S. Schimanckas Pat. No. 3,183,880 and a propulsion unit connected to the transom for vertical tilting movement and for steering movement. While other arrangements known in the art can be employed, such as that shown in U.S. Pat. No. 3,183,880 issued May 18, 1965 and incorporated herein by reference, in the disclosed construction, the stern drive unit includes a gimbal housing 18 mounted on the outer surface of the boat transom 14 and fixedly attached to the boat transom 14. The gimbal housing 18 can be attached to the boat transom 14 by any suitable means such as bolts (not shown) extending through the transom 14.

The stern drive also comprises a gimbal ring 20 connected to the gimbal housing 18 for pivotal movement relative to the gimbal housing 18 about a generally vertical steering axis (not shown), and a propulsion unit 34 connected to the gimbal ring 20 for pivotal movement relative to the gimbal ring 20 about a generally horizontal tilt axis (not shown).

The propulsion unit 34 includes a pivot housing 30 which is connected to the gimbal ring 20, and a drive shaft 32 housing which is removably connected to the pivot housing 30 for common pivotal movement of the drive shaft housing 32 with the pivot housing 30. In the illustrated construction, the drive shaft housing 32 is removably connected to the pivot housing 30 by a plurality of bolts (not shown).

The propulsion unit 34 also includes a propeller 38 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 34. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

The marine propulsion device 10 also comprises means (not shown) for providing cooling water to the engine 16. Such means can include a pump for pumping water to the engine 16 as is well known in the art.

The marine propulsion device 10 further comprises an exhaust outlet 60, and an exhaust passageway 62 communicating between the engine 16 and the exhaust outlet 60 and conducting exhaust gases and coolant water away from the engine 16. In the illustrated construction, the exhaust outlet 60 is located at the lower end of the propulsion unit 34 so that the exhaust gases are discharged underwater. It is well known in the art to discharge exhaust gases underwater in order to reduce noise.

In the preferred embodiment, the exhaust passageway 62 extends from the engine 16 to the gimbal housing 18, through the gimbal housing 18, from the gimbal housing 18 to the propulsion unit 34, and through the propulsion unit 34 to the exhaust outlet 60.

The portion of the exhaust passageway 62 extending from the gimbal housing 18 to the propulsion unit 34 is an exhaust bellows 64.

The portion of the exhaust passageway 62 extending through the propulsion unit 34 is also conventional and need not be described in greater detail.

Figure 5:
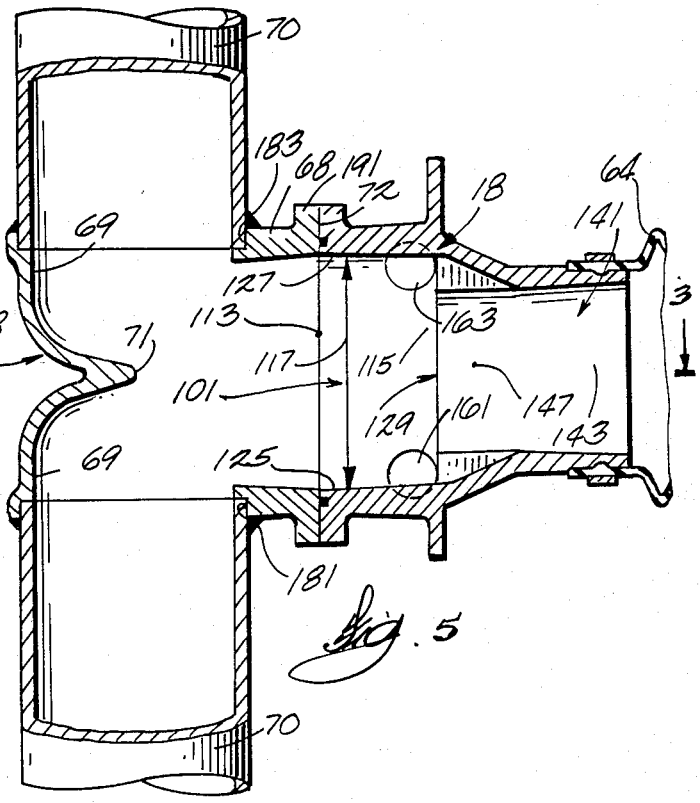
FIG. 5 is an enlarged schematic partial view taken generally along line 5—5 in FIG. 2.

The portion of the exhaust passageway 62 extending between the engine 16 and the gimbal housing 18 is an exhaust conduit arrangement 66 including (see FIGS. 1 and 5) a conduit section which is in the form of a dual elbow 68 and which communicates with the gimbal housing 18, and a pair of exhaust pipes 70 communicating with the engine 16 and converging into the dual elbow 68.

Upstream of the dual elbow 68, the exhaust pipes 70 are mirror images of each other. One pipes 70 communicates with one side of the engine 16, and the other pipe 70 communicates with the other side of the engine 16. The assembly of the two exhaust pipes 70 is generally U-shaped, with the upstream or upper ends of the pipes 70 communicating with the engine 16. The pipes 70 curve inwardly and somewhat rearwardly as they extend downwardly, and the pipes 70 turn so as to extend inwardly and generally horizontally just upstream of the dual elbow 68. Within the elbow 68, the forward walls 69 (to the left in FIG. 5) smoothly curve rearwardly and come to a point 71. The curved forward walls 69 of the elbow cause the exhaust gases and coolant water discharge to turn and flow rearwardly. The dual elbow 68 terminates in an end face 72 which abuts the front end of the gimbal housing 18 when the exhaust system is completely assembled.

The exhaust passage 62 in the gimbal housing 18 comprises conduit means 101 for receiving a mixture of exhaust gas and coolant discharge from the dual elbow 68 and for discharging exhaust gas through the bellows 64 and to the propulsion unit 34 and for discharging coolant to the atmosphere independently of the propulsion unit 34.

More particularly, when the gimbal housing 18 is boat mounted, the conduit means 101 extends, in part, generally horizontally through the gimbal housing 18 and includes a forwardly located inlet passage 111 which includes an inlet end 113 communicating with the elbow 68, and an outlet end, and which is approximately rectangular in configuration throughout the distance between the inlet and outlet ends 113 and 115. The rectangular cross section has a length or horizontal width 117 extending horizontally and transversely and a vertical width or height 119 which extends generally vertically. Preferrably the length or horizontal width 117 is about one-hundred fifty percent (150%) of the height or vertical width 119.

The inlet passage 111 includes interconnected bottom, top, and opposed side walls 121, 123, 125 and 127 respectively. At the outlet end 115, the lower half of the inlet passage 111 is closed, except as is explained hereinafter, by a partial transverse wall 129, i.e., closes a portion of the bottom half of the inlet passage 111.

As a consequence, the inlet passage 111 is undivided forwardly of the transverse wall 129, i.e., is entirely open between the bottom, top, and side walls 121, 123, 125 and 127 respectively, and from the inlet end 113 to the outlet end 115. In addition, at the outlet end 115, the upper half of the inlet passage 111 is open and the lower half is substantially closed by the transverse half wall 129, except as hereinafter explained.

The conduit means 101 also includes an exhaust gas discharge passage 141 which communicates with and extends generally horizontally and rearwardly from the inlet passage 111 and which is of lesser cross-sectional area than the cross-sectional area of the inlet passage 111. The exhaust gas discharge passage 141 includes a rearwardly located outlet portion 143 which is preferably generally circular in cross section throughout and which includes and outlet end which, as shown in the drawings, is located in general alignement with the inlet end 113 of the inlet passage 111 and which is connected to the bellows 64. The diameter of the circular cross section of the outlet portion is approximately equal to the height 119 of the rectangular configuration of the inlet passage 111, and the top and bottom of the circular cross section are, as seen from the front, approximately tangent to the bottom and top walls 121 and 123 of the inlet passage 111. If desired the exhaust gas discharge passage 141 could be oval in shape.

The exhaust gas discharge passage 141 also includes a forwardly located intermediate transition portion 145 which is located forwardly of the outlet portion 143 and which includes a lower generally semi-circular part 147 and an upper transition part 149. At its rearward end, the upper transition part 149 is semi-circular in cross section (i.e., mating with the outlet portion 143). At the forward end, the upper transition part 149 is rectangular in cross section having a length or horizontal width equal to the length or horizontal width 117 of the inlet passage 111 and a height equal to about one-half the height 119 of the inlet passage 111, (i.e., mating with the upper half of the inlet passage 111). In the upper transition part 149, the top and side walls are inclined rearwardly and converge from the rectangular configuration to the semi-circular configuration.

The conduit means 101 also includes a pair of coolant discharge passages 161 and 163 which communicate between the inlet passage 111 forwardly of the half wall 129 and the exterior of the gimbal housing 18. While other constructions could be employed, in the disclosed construction, the coolant discharge passages 161 and 163 are circular in cross section and extend, as seen from the front, generally vertically in parallel relation to each other, and, as seen from the side, extend downwardly and somewhat rearwardly in laterally aligned relation to each other. At their lower ends, the coolant discharge passages 161 and 163 communicate with the atmosphere. At their upper ends, the passages 161 and 163 break through the bottom wall 121 of the inlet passage 111 adjacent the transverse half wall 129 and with the passage 161 adjacent the side wall 125 and with the passage 163 adjacent the other side wall 127. If desired, only one coolant discharge passage can be employed.

In the specifically disclosed construction, the upper portions of the coolant discharge passages 161 and 163 are provided, in part, by respective small recesses 171 and 173 in the side walls 125 and 127 of the inlet passage 111.

In the preferred construction, the dual elbow 68 is cast and includes (See FIG. 5) two opposing circular openings 181 and 183 to which the pipes 70 (which are formed from aluminum) 68 are inserted and welded. The interior of the dual elbow 68 is substantially open except for wall portions 69 guiding the exhaust gas and coolant discharge flow rearwardly into the inlet passage 111 in the gimbal housing 18. The elbow 68 includes a discharge opening with a configuration corresponding to the inlet end 113 of the conduit means 101 in the gimbal housing 18. In addition, the elbow 68 includes a flange 191 facilitating bolting of the elbow 68 on the gimbal housing 18 with the elbow discharge opening and the inlet passage 111 in alignment to facilitate smooth flow into the gimbal housing 18.

Figure 4:
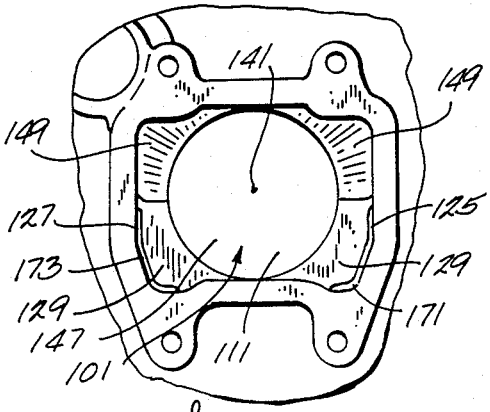
FIG. 4 is a sectional view taken along line 4—4 of FIG. 3.
Figure 3:
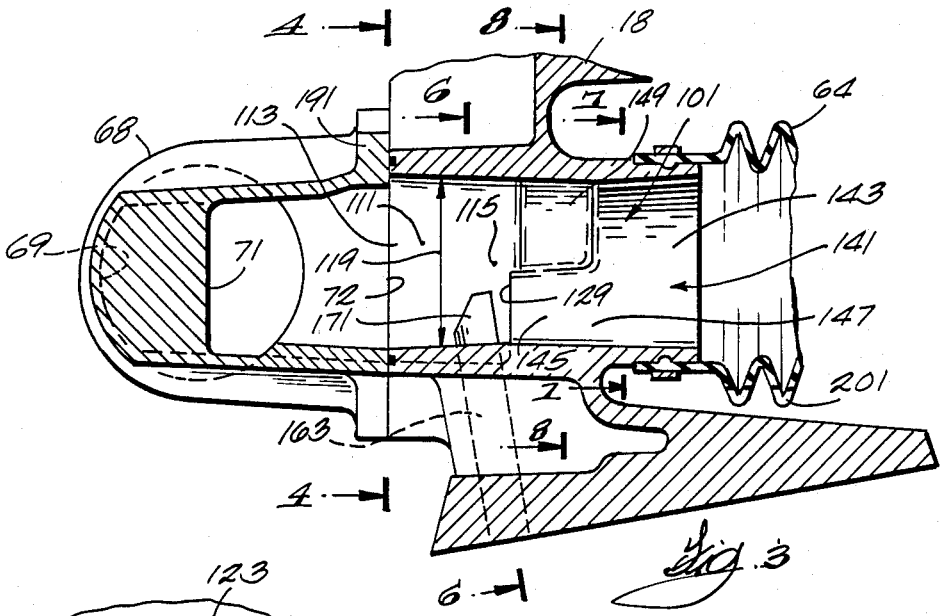
FIG. 3 is a sectional view taken along line 3—3 of FIG. 5.
Figure 6:
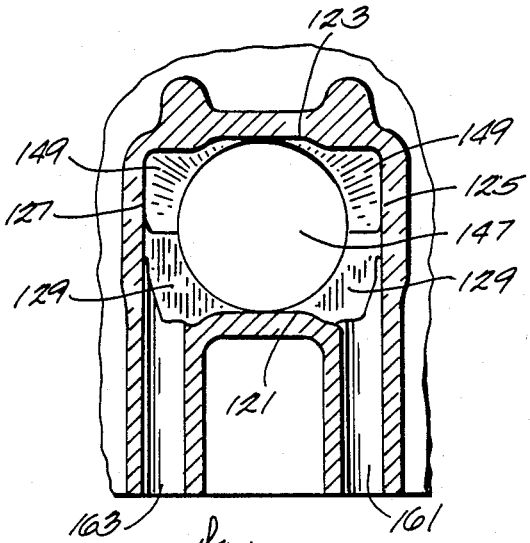
FIG. 6 is a sectional view taken along line 6—6 in FIG. 3.
Figure 8:
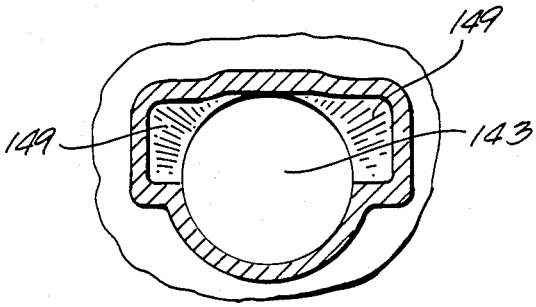
FIG. 8 is a sectional view taken along line 8—8 in FIG. 3.
Figure 7:
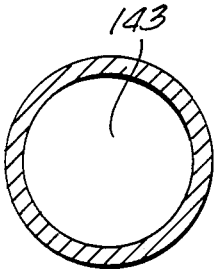
FIG. 7 is a sectional view taken along line 7—7 in FIG. 3.

As can be seen from the drawings (see especially FIGS. 3, 4 and 6) the bottom wall 121 of the inlet passage 111 and the bottom of the dual elbow 68 include, on each side of the center, aligned recessed portions or troughs or gutters which lead directly to the coolant discharge passages 161 and 163 and which are intended to guide coolant flow to the coolant discharge passages 161 and 163.

As already noted, the inlet passage 111 is totally open in the interior and communicates, adjacent the transverse half wall 129, with the coolant discharge passages 161 and 163 which open through the bottom wall 121 and which are located adjacently in front of the transverse half wall 129 and respectively adjacent the side walls 125 and 127.

In addition, the inlet passage 111 communicates with the circular outlet portion 143 of the exhaust gas discharge passage 141 through the intermediate transition portion 145 which, at the bottom or lower part 147, is semi-circular, (and passes through the transverse half wall 129) and through a transition upper half part 149 which changes in shape from a rectangular cross section corresponding to the configuration of the upper half of the inlet passage 111 to a semi-circular cross section corresponding to the upper half of the outlet portion 143 of the exhaust gas discharge passage 141.

As a consequence, exhaust gases smoothly transit through the right angle bends in the elbow 68 and flow through an otherwise unobstructed path in the exhaust elbow 68 and in the inlet passage 111 of the conduit means 101. Coolant flowing from the elbow 68 to the gimbal housing 18 is generally located along the bottom of the inlet passage 111 and, except at the central portion of the bottom wall 121, flows against the transverse half wall 129 and then flows downwardly through the coolant discharge passages 161 and 163. Some coolant will flow rearwardly through the exhaust gas discharge passage 141 for discharge to the atmosphere rearwardly of the gimbal housing 18. However, sufficient coolant is discharged through the coolant discharge passages 161 and 163, and the exhaust gas flow through the conduit means 101 is sufficiently smooth, so that back pressure on the engine is maintained at an acceptable level.

Another feature of the invention resides in the formation of one or more restricted openings 201 along the bottom of the folds of the bellows 64 connecting the gimbal housing 18 with the pivot housing 30, which openings are substantially closed when the propulsion unit 34 is in a full down position and which are progressively opened as the bellows 64 is expanded in response to upward displacement of the propulsion unit 34. Such opening of the bellows 64 along the lower portion thereof permits additional discharge of coolant from the exhaust gas before passage through the propulsion unit 34.

Various of the features of the invention are set forth in the following claims.

I claim:

1. A marine propulsion device comprising a stern drive unit including a member adapted to be fixed to a boat transom, or fixed to an engine assembly having a portion passing through a transom, a propulsion unit connected to said member for pivotal steering movement relative to said member and for vertical tilting movement relative to said member, an exhaust gas passage in said propulsion unit and including an outlet normally located under water and an inlet normally located above water, a flexible exhaust gas bellows having a rearward end connected to said inlet of said exhaust gas passage in said propulsion unit and having a forward end, and an exhaust gas and coolant discharge conduit comprising a forwardly located inlet passage located in said member and adapted to receive combined exhaust gas and coolant discharge from an engine and including a rearwardly located lower transverse partial wall, said inlet passage being undivided forwardly of said lower transverse partial wall, an exhaust gas discharge passage located in said member rearwardly of and communicating with said inlet passage above said lower transverse partial wall, said exhaust gas discharge passage having a rearward end connected to said forward end of said bellows, and a coolant discharge passage located in said member and communicating with said inlet passage in forwardly adjacent relation to said lower transverse partial wall.

2. A marine propulsion device comprising a stern drive unit including a gimbal housing adapted to be fixed to a boat transom, a gimbal ring connected to said gimbal housing for pivotal movement relative to said gimbal housing about a generally vertical axis, a propulsion unit connected to said gimbal ring for pivotal movement relative to said gimbal ring about a generally horizontal axis and including a propeller shaft, an exhaust gas passage in said propulsion unit and including an outlet normally located under water and an inlet normally located above water, a flexible exhaust gas bellows having a rearward end connected to said inlet of said exhaust gas passage in said propulsion unit and having a forward end, and an exhaust gas and coolant discharge conduit comprising a forwardly located inlet passage located in said gimbal housing and adapted to receive combined exhaust gas and coolant discharge from an engine, said inlet passage including an outlet end, a bottom wall, a side wall, and, at said outlet end, a lower transverse partial wall, a rearwardly located exhaust gas discharge passage located in said gimbal housing and including an outlet portion connected to said forward end of said bellows, and an intermediate portion having an upper part with a forward end communicating with said inlet passage and with a rearward end communicating with said outlet portion of said exhaust gas discharge passage, said intermediate portion also having a lower part having a forward end communicating through said lower transverse partial wall with said inlet passage and a rearward end communicating with said outlet portion of said exhaust gas discharge passage, and a coolant discharge passage located in said gimbal housing and communicating with said inlet passage through said bottom wall and adjacent said side wall and said lower transverse partial wall.

3. A housing adapted to be mounted on a boat transom, said housing including an exhaust gas and coolant discharge conduit extending through said housing and comprising a forwardly located inlet passage adapted to receive combined exhaust gas and coolant discharge from an engine and including a rearwardly located lower transverse partial wall and being undivided forwardly of said lower transverse partial wall, an exhaust gas discharge passage located rearwardly of and communicating with said inlet passage above the lower transverse partial wall, said exhaust gas discharge passage having a rearward outlet end in general alignment with said forwardly located inlet end of said inlet passage, and a coolant discharge passage communicating with said inlet passage in forwardly adjacent relation to said lower transverse partial wall.

4. A housing adapted to be mounted on a boat transom, said housing including an exhaust gas and coolant discharge conduit extending through said housing and comprising a forwardly located inlet passage adapted to receive combined exhaust gas and coolant discharge from an engine, said inlet passage including a forwardly located inlet end, an outlet end, a bottom wall, a side wall, and, at said outlet end, a lower transverse partial wall, a rearwardly located exhaust gas discharge passage including an outlet portion having an outlet end in general alignment with said inlet end of said inlet passage, and an intermediate portion having an upper part with a forward end communicating with said inlet passage and a rearward end communicating with said outlet portion of said exhaust gas discharge passage, said intermediate portion also having a lower part having a forward end communicating through said lower transverse partial wall with said inlet passage and a rearward end communicating with said outlet portion of said exhaust gas discharge passage, and a coolant discharge passage communicating with said inlet passage through said bottom wall and adjacent said side wall and said lower transverse partial wall.

5. A housing adapted to be mounted on a boat transom, said housing including an exhaust gas and coolant discharge conduit extending through said housing and comprising a forwardly located inlet passage adapted to receive combined exhaust gas and coolant discharge, said inlet passage including an inlet end and an outlet end, and being of generally constant generally rectangular configuration between said inlet end and said outlet end, and including a bottom wall, a side wall, and, at said outlet end, a lower transverse partial wall, a rearwardly located exhaust gas discharge passage including an outlet portion of generally constant circular cross section, and an intermediate portion having an upper part with a forward end communicating directly with said inlet passage and with a rearward end communicating with said outlet portion of said exhaust gas discharge passage, the upper part tapering inwardly and rearwardly from said inlet passage to said outlet portion, said intermediate portion also having a lower part having a forward end communicating through the lower transverse partial wall with the inlet passage and a rearward end communicating with the outlet portion of the exhaust gas discharge passage, and a coolant discharge passage communicating with the inlet passage through said bottom wall and adjacent said side wall and said lower transverse partial wall.

6. A housing in accordance with claim 5 wherein said inlet passage includes a second side wall spaced from said first mentioned side wall, and further including a second coolant discharge passage communicating through said bottom wall and adjacent said second side wall and said lower transverse partial wall.

7. A housing in accordance with claim 6 wherein said first mentioned coolant discharge passage and said second coolant discharge passage extend downwardly and rearwardly from said bottom wall.

8. A housing in accordance with claim 6 wherein said first mentioned coolant discharge passage and second coolant discharge passage extend in parallel relation.

9. A housing in accordance with claim 5 wherein said inlet passage also includes a top wall and is wholly open interiorly of said bottom, top and side walls.

10. A housing in accordance with claim 5 wherein said upper part of said intermediate portion of said exhaust gas discharge passage changes in cross section from a downwardly open u-shape adjacent to said inlet passage to a downwardly open semi circular shape adjacent to said outlet portion of said exhaust gas discharge passage.

11. A housing in accordance with claim 5 wherein said inlet passage has a rectangular cross section with a height and wherein said circular cross section of said outlet portion of said exhaust gas discharge passage has a diameter, and wherein said circular cross section has an upper portion and a lower portion which are respectively approximately tangentially oriented with respect to said top wall and said bottom wall of said inlet passage.

12. A housing in accordance with claim 5 wherein said transverse half wall has therein an upwardly open semi-circular cut-out affording communication between said inlet passage and said intermediate portion of said exhaust gas discharge passage.

* * * * *